US012800243B2

(12) United States Patent
Christiono et al.

(10) Patent No.: US 12,800,243 B2
(45) Date of Patent: Nov. 17, 2026

(54) DOUBLE PIPE HEAT EXCHANGER CONNECTION, METHOD OF MAKING SAME, AND QUENCH EXCHANGER DESIGN INCLUDING SAME

(71) Applicants: Paulus Harijadi Christiono, Sugar Land, TX (US); Patrick Wayne Guy, Tomball, TX (US)

(72) Inventors: Paulus Harijadi Christiono, Sugar Land, TX (US); Patrick Wayne Guy, Tomball, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 17 days.

(21) Appl. No.: 18/637,273

(22) Filed: Apr. 16, 2024

(65) Prior Publication Data

US 2024/0353187 A1 Oct. 24, 2024

Related U.S. Application Data

(60) Provisional application No. 63/497,154, filed on Apr. 19, 2023.

(51) Int. Cl.
*F28F 9/18* (2006.01)
*F28D 7/10* (2006.01)
(Continued)

(52) U.S. Cl.
CPC ..... *F28F 9/182* (2013.01); *F28D 7/103* (2013.01); *F28F 1/003* (2013.01); *F28F 9/0268* (2013.01)

(58) Field of Classification Search
CPC ..... F16L 39/005; F28D 7/103; F28D 7/106; F28F 1/003; F28F 9/0243; F28F 9/0246; F28F 9/0268; F28F 9/182
See application file for complete search history.

(56) References Cited

U.S. PATENT DOCUMENTS 1,833,876 A 11/1931 McGrath
4,997,211 A * 3/1991 Brucher ..... F16L 59/16 285/47

(Continued)

FOREIGN PATENT DOCUMENTS

EP 3899396 B1 † 9/2022

OTHER PUBLICATIONS

International Searching Authority, Patent Cooperation Treaty; International Search Report and Written Opinion dated Sep. 18, 2024 for International Application No. PCT/US2024/024805 filed Apr. 16, 2024; 20 pages.

*Primary Examiner* — Eric S Ruppert
*Assistant Examiner* — Hans R Weiland
(74) *Attorney, Agent, or Firm* — Gary Machetta

(57) ABSTRACT

A piping connection system and method to connect a double pipe system such as a double pipe heat changer to a housing, for example a housing of a manifold. In examples, the piping connection system and method may include a transition member configured to bond or connect to the double pipe system and to the housing. In examples, the piping connection system may include a baffle configured to redirect flow from the housing to the double pipe system through an opening and towards the transition member. In examples, the piping connection system and method may be used to manufacture a quench exchanger such as a primary quench exchanger.

12 Claims, 6 Drawing Sheets

(51) Int. Cl.
*F28F 1/00* (2006.01)
*F28F 9/02* (2006.01)

(56) References Cited

U.S. PATENT DOCUMENTS

| | | | | | |
|---|---|---|---|---|---|
| 5,579,831 | A * | 12/1996 | Brucher | F28F 9/02 | 165/154 |
| 5,813,453 | A * | 9/1998 | Brucher | F28D 7/106 | 165/158 |
| 7,287,578 | B2 * | 10/2007 | Ricci | F28F 9/0246 | 165/154 |
| 7,900,969 | B2 * | 3/2011 | Birk | F28F 9/0246 | 228/183 |
| 8,726,794 | B2 | 5/2014 | van der Eerden et al. | | |
| 2010/0319888 | A1 * | 12/2010 | Birk | F28D 7/12 | 285/47 |
| 2015/0107806 | A1 | 4/2015 | Glass | | |
| 2020/0103173 | A1 * | 4/2020 | Namarvar | F28F 9/0246 | |
| 2021/0381774 | A1 | 12/2021 | Zanardi et al. | | |

* cited by examiner
† cited by third party

DOUBLE PIPE HEAT EXCHANGER CONNECTION, METHOD OF MAKING SAME, AND QUENCH EXCHANGER DESIGN INCLUDING SAME

CROSS-REFERENCE TO RELATED APPLICATIONS

This application claims the benefit of U.S. Provisional Patent Application No. 63/497,154, filed on Apr. 19, 2023, which is hereby incorporated by reference for all purposes as if fully set forth herein.

FIELD OF THE INVENTION

The present disclosure relates to a system and method of making a connection to a bank of double pipe heat exchanger and to form a quench exchanger design including the same.

BACKGROUND

Heat exchangers are ubiquitous equipment in various types of applications. One known heat exchanger design is the double pipe heat exchanger. In a double pipe heat exchanger two concentric pipes, an inner pipe located inside an outer pipe, are arranged so that fluid can pass through the inner pipe and between the inner and outer pipe. Heat is exchanged via heat transfer from the two fluids flowing through the heat exchanger. Additional heat exchange may also be experienced between the fluid flowing between the inner pipe and outer pipe and the environment outside the outer pipe. In examples, the fluid flowing through the inner and outer pipes can be configured to be concurrent, i.e. in the same direction, or countercurrent, i.e. in opposite directions.

In a typical operation of a double pipe heat exchanger, flow connections are made to the inner pipe and to the outer pipe. Often the connections to each pipe are made separate and independent of each other so that fluid flow, fluid type, and/or temperature of the fluid in each pipe can be controlled to achieve the desired heat transfer.

Generally, connections are provided using one or more pipes and pipe junctions that may require complex manufacturing steps, materials, and that can require constant maintenance or be prone to failure. This is especially when a double pipe heat exchanger is integrated into other structures such as a quench exchanger. Accordingly, there is a need in the art for improved pipe connections and reliable design of double pipe heat exchangers.

SUMMARY OF THE INVENTION

In examples, disclosed is a double pipe heat exchanger connection, method of making such connection, and quench exchanger design including such connection that can substantially obviates one or more of the problems due to limitations and disadvantages of the related art.

Examples can provide an improved system and/or method over the already existing systems and/or methods.

Examples may provide simplified connections to a double pipe heat exchanger or a bank of double pipe heat exchangers.

Examples may provide more resilient connections to a double pipe heat exchanger or a bank of double pipe heat exchangers.

Examples may provide a quench exchanger benefitting of the advantages described herein.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

A pipe connection system including a transition member configured to be bonded to an inner pipe of a double pipe system; a housing having an outer perimeter configured to be bonded to an outer pipe of the double pipe system and to the transition member; and a baffle defining an opening proximate the transition member and arranged to deflect flow towards the transition member and through the opening, wherein the opening provides fluid communication between the housing and a space between the outer pipe and the inner pipe of the double pipe system.

A quench exchanger including a double pipe heat exchanger having an inner pipe and an outer pipe; a first transition member connected to an inner pipe of the double pipe heat exchanger; a first manifold connected to the double pipe heat exchanger and to the first transition member; and a first baffle defining a first opening proximate the first transition member, the first baffle arranged to deflect flow towards the first transition member and through the first opening, wherein the first opening provides fluid communication between the first manifold and a space between the outer pipe and the inner pipe of the double pipe heat exchanger.

In examples, the quench exchanger may include a second transition member connected to the inner pipe of the double pipe heat exchanger; a second manifold in flow connection with the double pipe heat exchanger and to the second transition member; and a second baffle defining a second opening proximate the second transition member, the second baffle arranged to deflect flow towards the second transition member and through the second opening, wherein the second opening provides fluid communication between the second manifold and the space between the outer pipe and the inner pipe of the double pipe heat exchanger.

In examples, the first transition member and the first manifold may be located proximate to a first end of the double pipe heat exchanger and the second transition member and the second manifold are located proximate a second end, opposite the first end, of the double pipe heat exchanger.

In examples, the first baffle may include a first portion of the outer pipe of the double pipe heat exchanger.

In examples, the first baffle may be an integral portion of the first manifold.

In examples, the second baffle may include a second portion of the outer pipe of the double pipe heat exchanger. In examples, the second baffle may be an integral portion of the second manifold.

In examples, a method of making a flow connection to a double pipe heat exchanger may include bonding via external welding a first transition member to a surface of a first outer portion of an inner pipe of the double pipe heat exchanger; and bonding a first manifold to the first transition member and to an outer surface of an outer pipe of the double pipe heat exchanger.

In examples, the first transition member may be bonded to the surface of the first outer portion of the inner pipe of the double pipe heat exchanger that is proximate to a first opening at the outer surface of the outer pipe of the double pipe heat exchanger.

In examples, the method may include bonding the first manifold to the first transition member and to the outer surface of the outer pipe further comprises defining a first flow path from the first manifold, through the first opening, and into a space between the inner pipe of the double pipe heat exchanger and the outer pipe of the double pipe heat exchanger, wherein the first opening is configured to constrict the first flow path from the first manifold to the space between the inner pipe of the double pipe heat exchanger and the outer pipe of the double pipe heat exchanger.

In examples, the method may include bonding via external welding a second transition member to a surface of a second outer portion of the inner pipe of the double pipe heat exchanger; and bonding a second manifold to the second transition member and to the outer surface of an outer pipe of the double pipe heat exchanger.

In examples, the second transition member may be bonded to the surface of the second outer portion of the inner pipe of the double pipe heat exchanger that is proximate to a second opening at the outer surface of the outer pipe of the double pipe heat exchanger.

In examples, the method may include bonding the second manifold to the second transition member and to the outer surface of the outer pipe further comprises defining a second flow path from the second manifold, through the second opening, and into the space between the inner pipe of the double pipe heat exchanger and the outer pipe of the double pipe heat exchanger, wherein the second opening is configured to constrict the second flow path from the second manifold to the space between the inner pipe of the double pipe heat exchanger and the outer pipe of the double pipe heat exchanger.

In examples, a method of making a primary quench exchanger may include providing a plurality of double pipe heat exchangers, each double pipe heat exchanger having an inner pipe located within an outer pipe; bonding via external welding a first transition member to a first portion of an outer surface of each inner pipe of each double pipe heat exchanger; and bonding a first manifold to the first transition member and to an outer surface of each outer pipe of the double pipe heat exchanger.

In examples, the first transition member may be bonded to the first portion of an outer surface of each the inner pipe of the double pipe heat exchanger that is proximate to a first opening at each respective outer pipe of each double pipe heat exchanger.

In examples, the method may include bonding the first manifold to the first transition member and to the outer surface of each outer pipe of the double pipe heat exchanger to define a respective first flow path from the first manifold to each double pipe heat exchanger, wherein each respective first flow path extends from the first manifold, through the first opening in each respective outer pipe of each double pipe heat exchanger, and into a space between each respective inner pipe and outer pipe of each double pipe heat exchanger, wherein the first opening in each respective outer pipe of each double pipe heat exchanger is configured to constrict the respective first flow path from the first manifold to the respective space between the inner pipe and the outer pipe of the respective double pipe heat exchanger.

In examples, the method may include bonding via external welding a second transition member to a second portion of an outer surface of each inner pipe of each double pipe heat exchanger; and bonding a second manifold to the second transition member and to the outer surface of each outer pipe of the double pipe heat exchanger.

In examples, the second transition member may be bonded to the second portion of an outer surface of each the inner pipe of the double pipe heat exchanger that is proximate to a second opening at each respective outer pipe of each double pipe heat exchanger.

In examples, the method may include bonding the second manifold to the second transition member and to the outer surface of each outer pipe of the double pipe heat exchanger further comprises defining a respective second flow path from the second manifold to each double pipe heat exchanger, wherein each respective second flow path extends from the second manifold, through the second opening in each respective outer pipe of each double pipe heat exchanger, and into a space between each respective inner pipe and outer pipe of each double pipe heat exchanger, wherein the second opening in each respective outer pipe of each double pipe heat exchanger may be configured to constrict the respective second flow path from the second manifold to the respective space between the inner pipe and the outer pipe of the respective double pipe heat exchanger.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Figure 1:
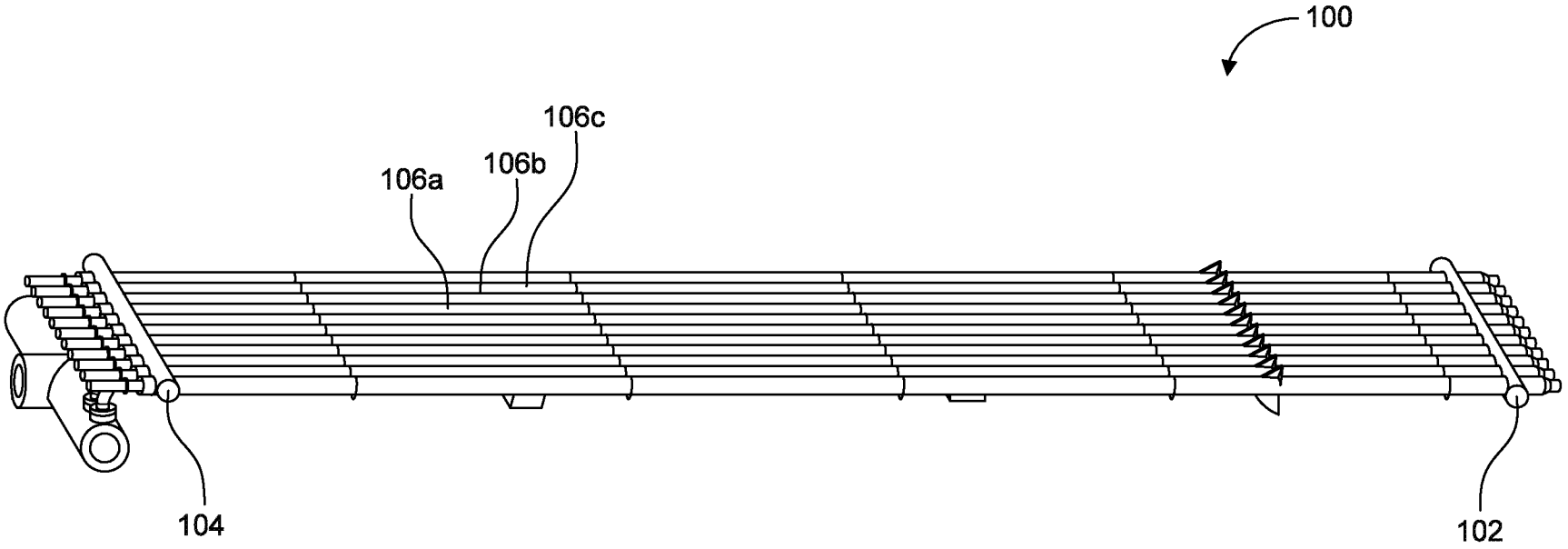
FIG. 1 illustrates an example of a quench exchanger that may be implemented with one or more piping connection systems as described herein.

Reference will now be made in detail to examples illustrated in the accompanying drawings.

In examples, one or more pipe connection systems and methods as described herein may be employed to make a flow connection to one or more double pipe structures. In examples, a double pipe structure may include a double pipe heat exchanger or a bank of double pipe heat exchangers. However, the pipe connection systems and methods as described may also be applied to other double pipe systems.

In examples, one or more pipe connection systems and methods as described herein may be used in manufacturing a quench exchanger or quench exchanger system. In examples, a quench exchanger or quench exchanger system may include one or more double pipe heat exchangers in flow connection with one or more manifolds. In examples, the one or more pipe connection systems and methods as described herein may be used to connect one or more manifolds to one or more double pipe heat exchangers and/or a bank of double pipe heat exchangers to form a quench exchanger or quench exchanger system. In examples, a quench exchanger or quench exchanger system may be a primary quench exchanger (PQE). In examples, a PQE may be used to cool hot effluent from a hydrocarbons cracking furnace. In examples, a PQE may be used to cool hot gaseous effluent while generating steam. In examples, the quench exchanger or quench exchanger system, such as a PQE or other quench exchanger, may be used to connect boiler feed water manifolds, steam manifolds, or a combination of both.

The techniques and systems described herein may be implemented in several ways. Example implementations are provided below with reference to the figures.

Unless defined otherwise, all technical and scientific terms used herein have the same meaning as is commonly understood by one of skill in the art to which the inventions belong. All patents, patent applications, published applications and publications, websites and other published materials referred to throughout the entire disclosure herein, unless noted otherwise, are incorporated by reference in their entirety. Where there is a plurality of definitions for terms herein, those in this section prevail. Where reference is made to a URL or other such identifier or address, it is understood that such identifiers can change and information on the internet can come and go, but equivalent information can be found by searching the internet. Reference thereto evidences the availability and public dissemination of such information.

As used herein, the singular forms "a", "an" and "the" include plural referents unless the context clearly dictates otherwise.

The terms first, second, third, etc. as used herein can describe various elements, components, regions, layers and/or sections, these elements, components, regions, layers and/or sections should not be limited by these terms. These terms may be only used to distinguish one element, component, region, layer or section from another region, layer, or section. Terms such as "first", "second", and other numerical terms when used herein do not imply a sequence or order unless clearly indicated by the context. Thus, a first element, component, region, layer, or section discussed below could be termed a second element, component, region, layer, or section without departing from the teachings of the example embodiments.

As used herein, ranges and quantities can be expressed as "about" a particular value or range. "About" also includes the exact amount. Hence "about 5 percent" means about 5 percent in addition to 5 percent. The term "about" means within typical experimental error for the application or purpose intended.

As used herein, "and/or" includes any and all combinations of one or more of the associated listed items.

As used herein, a "combination" refers to any association between two items or among more than two items. The association can be spatial or refer to the use of the two or more items for a common purpose.

As used herein, "comprising" and "comprises" are to be interpreted to mean "including but not limited to" and "includes but not limited to", respectively.

As used herein, "optional" or "optionally" means that the subsequently described event or circumstance does or does not occur, and that the description includes instances where the event or circumstance occurs and instances where it does not. For example, an optional component in a system means that the component may be present or may not be present in the system.

As used herein, "substantially" means "being largely but not wholly that which is specified."

As used herein "external welding" means welding of two or more parts together to form a join where the heat is applied to an exterior, outer, and/or front surface of the parts. In examples, external welding excludes inner bore welding.

As used herein "welding" refers to a process that uses heat to bond or connect the parts together. In examples, welding may include a heat process in the range of about 205° C. to about 315° C. for preheat, and about 677° C. to about 700° C. for post weld heat treatment to allow the parts to have proper fusion. In examples, any suitable welding temperature for pipe connections may be used between preheat and post weld may be implemented to form the bond or connection.

In examples, one or more pipe connection systems and methods as described herein may be implemented to construct a quench exchanger 100 such as, for example a PQE, with integrated manifolds 102 and 104 as for example illustrated in FIG. 1. In examples, integrated manifolds employing one or more pipe connection systems and methods as described herein can greatly simplify the manufacturing process. In examples, integrated manifolds employing one or more pipe connection systems and methods as described herein may also require less material to construct. In examples, integrated manifolds employing one or more pipe connection systems and methods as described herein may provide enhanced resilience.

Figure 2A:
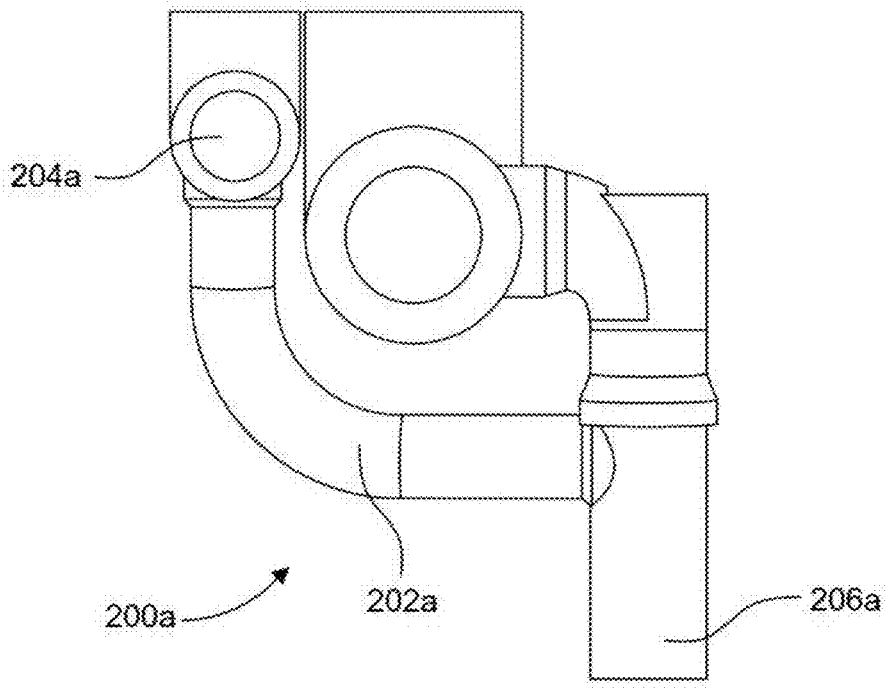
FIG. 2A (Prior Art)
FIGS. 2A and 2B illustrate prior art pipe connections.
Figure 2B:
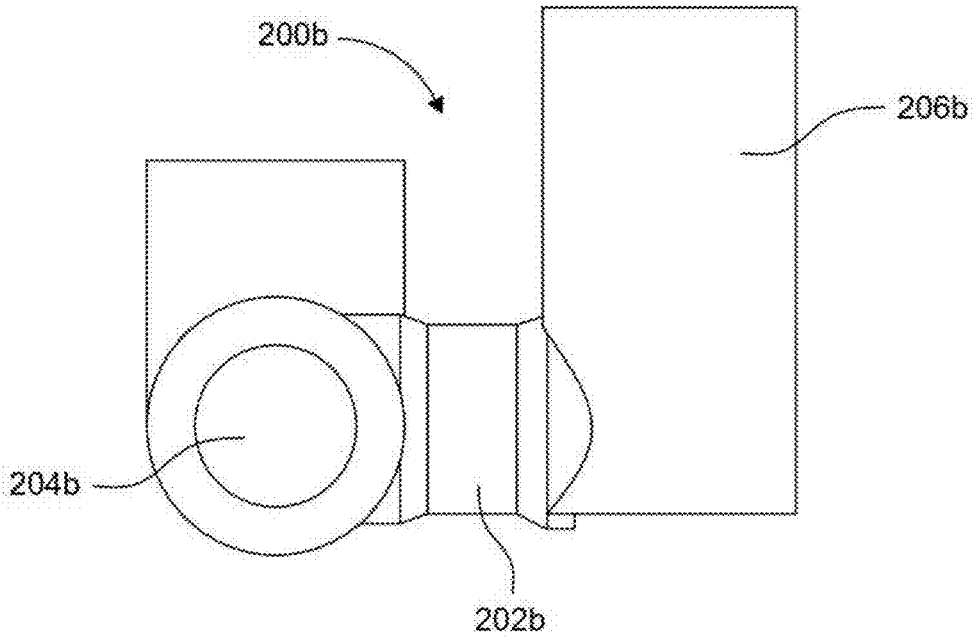
FIG. 2B (Prior Art)

Previous PQEs often connect manifolds via pipe connections that require additional material and manufacturing steps. For example, as illustrated in FIGS. 2A and 2B, a connection 200*a* or 200*b* as performed in the art may include a piping 202*a* or 202*b* that must be connected at one end to a manifold 204*a* or 204*b* and to a piping such as a heat exchanger 206*a* or 206*b*. The multiple connections require added process steps and materials. In examples, the added piping may not be able to withstand external nozzle loads and/or may be prone to clogging and/or wall thinning. These issues have often lead to the use of much thicker piping. In examples, improved connections can address one or more of these problems.

In examples, as shown in FIG. 1, a first manifold and a second manifold may be connected to one or more double pipe heat exchangers to form a PQE 100. In examples, the connections may include a transition member and a flow path design. As illustrated, in examples, a first manifold 102 and a second manifold 104 may be directly connected to one or more double pipe heat exchangers 106 (i.e. 106*a*, 106*b*, 106*c* etc. . . . ). In examples, by directly connected it is meant that the manifold is in physical contact with one or more double pipe heat exchangers. In examples, the flow connection between the one or more double pipe heat exchangers 106 and the first manifold 102 or second manifold 104 are made without the use of an intervening or connecting pipe.

Figure 3:
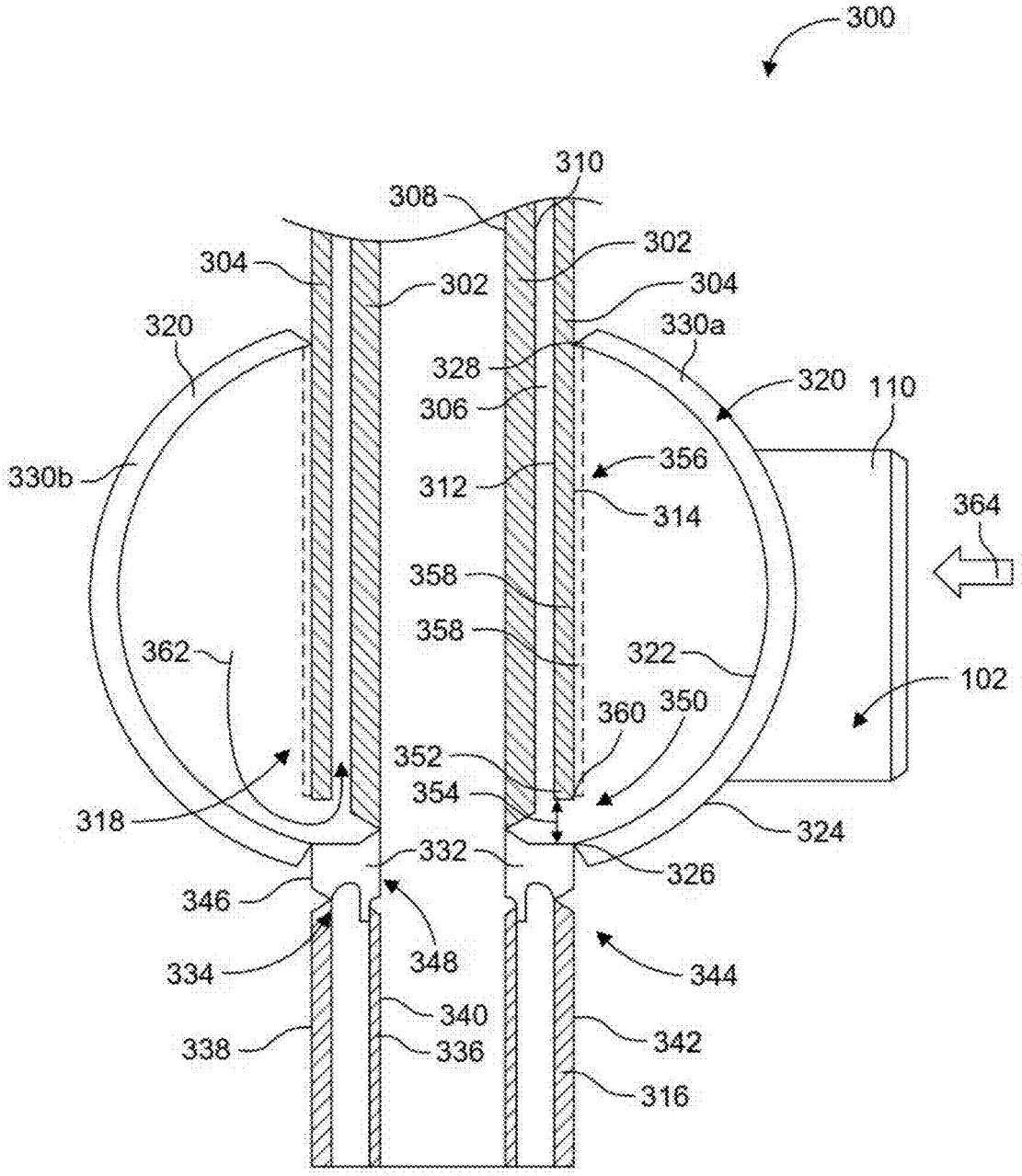
FIG. 3 illustrates a first example of a piping connection system as described herein.
Figure 4:
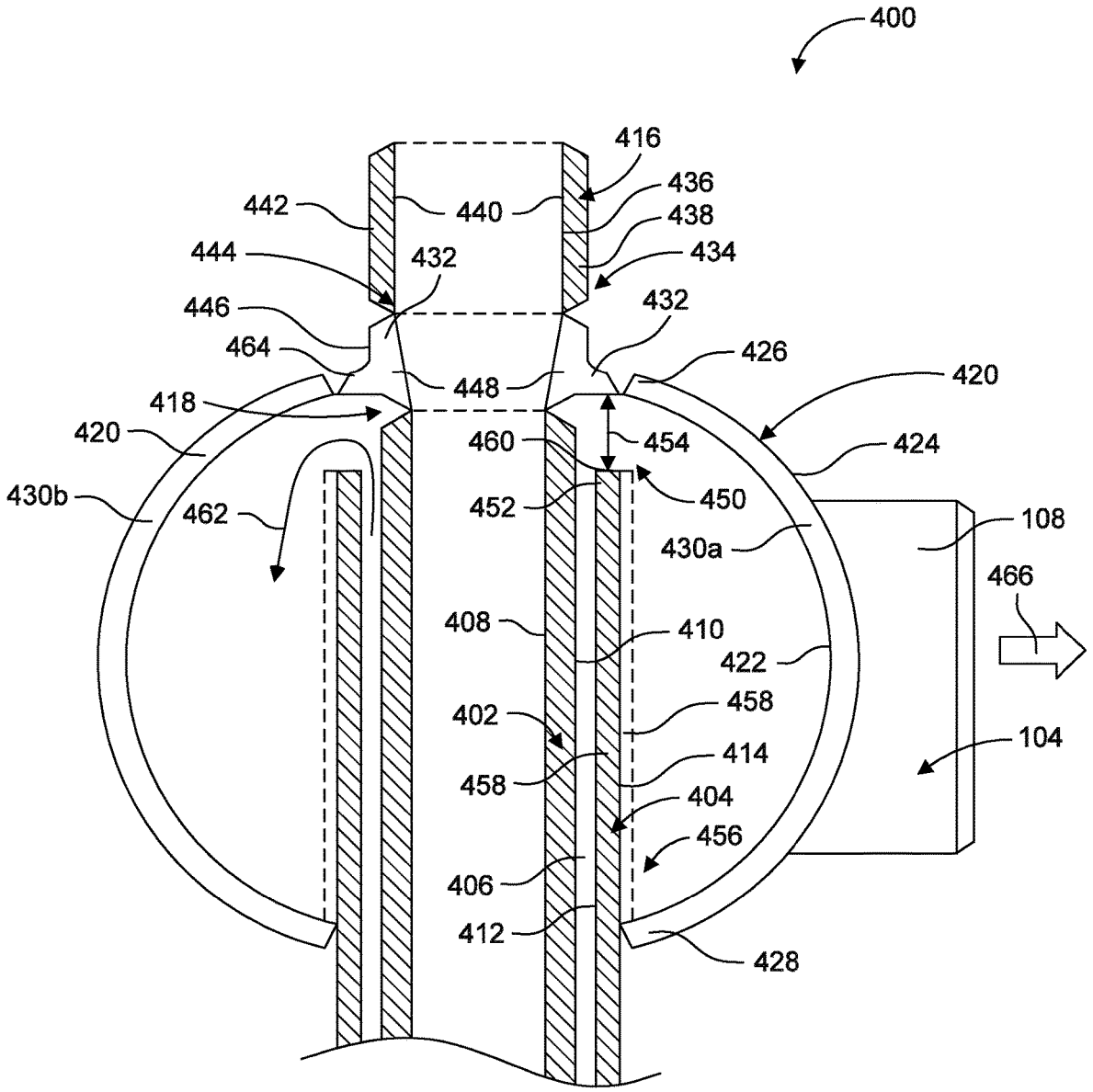
FIG. 4 illustrates a second example of a piping connection system as described herein.

FIGS. 3 and 4 illustrate a cross-section views of an example piping connection systems that may be used to connect a housing having to a double pipe system. As illustrated and described below, the housing may be that of a manifold or other like structure. As also illustrated and described below, the double pipe system may include a double pipe heat exchanger. As illustrated and described below, the piping connection systems may include a transition member configured to be bonded to the double pipe system and to the housing. Also, as illustrated and described, the piping connection systems may include a baffle configured to define an opening or gap proximate the transition member and arranged to deflect flow toward the transition member and through the opening or gap. In examples, as illustrated and described below, the opening or gap may provide a flow connection or fluid communication between the housing and a space between an inner pipe and an outer pipe of the double pipe system.

FIG. 3 illustrates a cross-section view of an example piping connection system that may be used to connect a first manifold 102 or second manifold 104 to a double pipe system having an inner pipe within an outer pipe such as a double pipe heat exchanger. In examples, 300 illustrates a piping connection system between a first manifold 102 and a double pipe system such as a double pipe heat exchanger 106. In the following description references a double pipe heat exchanger, however, any double pipe systems including an inner pipe and outer pipe as described below may be used in the piping connection system described.

In examples, as shown, a double pipe heat exchanger 106 may include an inner pipe 302 and an outer pipe 304. In examples, double pipe heat exchanger 106 and/or inner pipe 302 and outer pipe 304 may be made of any suitable materials. In examples, inner pipe 302 and outer pipe 304 may be made of the same or different materials. In examples, double pipe heat exchanger 106 and/or inner pipe 302 and outer pipe 304 may each independently be made of or include a metal, metal alloy, ceramic, plastic, glass, or any combination thereof. In examples, the material for double pipe heat exchanger 106 and/or inner pipe 302 and outer pipe 304 may be selected based on the temperatures of the fluid to flow therethrough. In examples, double pipe heat exchanger 106 and/or inner pipe 302 and outer pipe 304 may be made of or include a metal or metal alloy.

In examples, the thickness of inner pipe 302 may range from about 0.438 inches to about 0.674 inches. In examples, the thickness of outer pipe 304 may range from about 0.375 inches to about 0.719 inches. In examples, the inner pipe 302 and outer pipe 304 may have the same or different thicknesses.

In examples, the inner pipe 302 may be located within outer pipe 304. In examples, a space 306 may be defined between the inner pipe 302 and the outer pipe 304. In examples, inner pipe 302 may include an inner surface 308 and outer surface 310. In examples, outer pipe 304 may include an inner surface 312 and an outer surface 314. In examples, space 306 may be defined by an outer surface 310 of inner pipe 302 and an inner surface 312 of outer pipe 304.

In examples, the double pipe heat exchanger 106 may include a first inlet/outlet casting 316 connected at least to inner pipe 302 at a first end 318 of double pipe heat exchanger 106. In examples, the first inlet/outlet casting 316 may be made of or include any of the materials previously described for inner pipe 302 and outer pipe 304. In examples, the first inlet/outlet casting 316 may be made or include the same or different material as inner pipe 302 and/or outer pipe 304. In examples, first inlet/outlet casting 316 may include a metal or metal alloy.

In examples, first inlet/outlet casting 316 may be configured as an inlet and/or outlet flow connection to the inner pipe 302. In examples, first inlet/outlet casting 316 may be configured to inlet or outlet fluid in/from inner pipe 302 that is meant to experience heat transfer in the double pipe heat exchanger 106.

In examples, the first manifold 102 may include a housing 320. In examples, housing 320 may include any suitable shape. In examples, the housing 320 may be rounded, quadrilateral, polygonal, regular or irregular, symmetrical or non-symmetrical. In examples, housing 320 may include a manifold inner surface 322 and a manifold outer surface 324. In examples, the thickness of a wall of housing 320 of first manifold 102 may range from about 0.432 inches to about 0.906 inches.

In examples, the first joining end 326 and second joining end 328 may be located at opposite ends of housing 320 of the first manifold 102. In examples, housing 320 may include a first joining end 326 and a second joining end 328. In examples, the first joining end 326 and second joining end 328 may include openings in housing 320 through which a double pipe heat exchanger 106 and/or a first inlet/outlet casting 316 may be at least partially inserted.

In examples, the first manifold 102 may optionally include two or more sections 330*a*, 330*b*, etc., that may be joined together to form a closed housing around the outer perimeter of a double pipe heat exchanger. In examples, the two or more sections 330 may be bonded or connected together by welding, mechanically, by adhesive or any combination thereof to define a housing 320 and to bond or connect such housing 320 as described herein. In examples, first manifold 102 may include two or more sections 330 configured to define housing 320, first joining end 326, and second joining end 328 when bonded or connected together.

In examples, first manifold 102 may include any suitable material. In examples, first manifold 102 may be formed or include any material as described for the double pipe system and/or double pipe heat exchanger. In examples, first manifold 102 may include carbon steel.

In examples, a first transition member 332 may be provided between at least inner pipe 302 and first inlet/outlet casting 316. In examples, first transition member 332 may be provided to form a linear connection between first inlet/outlet casting 316 and inner pipe 302.

In examples, a first transition member 332 may be made of or include any suitable material. In examples, a first transition member 332 may be made of or include chromium or alloy thereof. In examples, first transition member 332 may be made of or include any material previously described for inner pipe 302 and/or outer pipe 304 of the double pipe heat exchanger 106. In examples, the first transition member 332 may be made of or include the same or different material as inner pipe 302 and/or outer pipe 304. In examples, the first transition member 332 may be made of or include the same or different material as the first inlet/outlet casting 316.

In examples, a first transition member 332 may be bonded or connected to the double pipe heat exchanger. In examples, as shown, a first transition member 332 may be bonded or connected to at least the outer surface 310 and/or first end 318 of inner pipe 302. In examples, a first transition member 332 may be configured to connect first inlet/outlet casting 316 to inner pipe 302.

In examples, first transition member 332 may be bonded or connected to a joining end 334 of first inlet/outlet casting 316. In examples, first transition member 332 may be bonded or connected to joining end 334 of first inlet/outlet casting 316 by welding, mechanically such as by screws, clamps, brackets or the like, via adhesive or any combination thereof. In examples, first transition member 332 may be an integral part of first inlet/outlet casting 316.

In examples, first transition member 332 may be formed at the same time and/or together with first inlet/outlet casting 316 during a casting process. In examples, first transition member 332 may be configured to extend from an inner portion 336 of first inlet/outlet casting 316 to an outer portion 338 of first inlet/outlet casting 316 when present and/or when bonded or connected to first inlet/outlet casting 316. In examples, inner portion 336 of first inlet/outlet casting 316 may include an inner surface 340 of first inlet/outlet casting 316. In examples, the inner surface 340 of first inlet/outlet casting 316 may be configured to form a contiguous flow path with inner surface 308 of inner pipe 302. In examples, outer portion 338 of first inlet/outlet casting 316 may include an outer surface 342 of first inlet/outlet casting 316. In examples, outer surface 342 of first inlet/outlet casting 316 may be substantially coplanar with outer surface 314 of outer pipe 304. In examples, outer surface 342 of first inlet/outlet casting 316 may not be coplanar with outer surface 314 of outer pipe 304. In examples, first transition member 332 may be configured to extend along the full perimeter 344 of inner surface 340 and/or outer surface 342 of first inlet/outlet casting 316 when present and/or when bonded or connected to first inlet/outlet casting 316.

In examples, first transition member 332 may be bonded or connected to inner pipe 302. In examples, first transition member 332 may be bonded or connected to inner pipe 302 by welding, mechanically such as by screws, clamps, brackets or the like, via adhesive or any combination thereof. In examples, when bonded or connected to inner pipe 302, the first transition member 332 may extend from inner surface 308 of inner pipe 302, from outer surface 310 of inner pipe 302, or from a point between inner surface 308 and outer surface 310 of inner pipe 302. In examples, when bonded or connected to inner pipe 302, the first transition member 332 may extend to a point that is recessed from, coplanar with, or extending past outer surface 324 of outer pipe 304. In examples, first transition member 332 may not be directly bonded or connected to outer pipe 304.

In examples, first transition member 332 may be configured such that boding or connecting first transition member 332 to inner pipe 302 and/or first inlet/outlet casting 316 may be performed by external welding. In examples, the welding may be performed at outer surface 310 and/or first end 318 of inner pipe 302. In examples, inner bore welding may not be required to connect first transition member 332 to inner pipe 302 and/or first inlet/outlet casting 316.

In examples, the first transition member 332 may be bonded or connected to inner pipe 302 at an inner portion 348. In examples, outer portion 346 and inner portion 348 of first transition member 332 may be at opposite halves of first transition member 332. For example, when first transition member 332 is present at joining end 334 of first inlet/outlet casting 316, the outer portion 346 may include an outer or external surface of first transition member 332 that is closest to the outer surface 342 of first inlet/outlet casting 316, while the inner portion 348 may include an inner or internal surface that is closest to the inner surface 340 of first inlet/outlet casting 316. In examples, when first transition member 332 is in the installed state, the outer portion 346 may extend approximately as far out as outer surface 314 of outer pipe 304 of double pipe heat exchanger 106, while the inner portion 348 may extend to inner pipe 302, for example to inner surface 308 of inner pipe 302.

In examples, when bonded and/or connected to inner pipe 302, first transition member 332 may extend along at least a portion of the perimeter of inner pipe 302. In examples, when bonded and/or connected to inner pipe 302, first transition member 332 may extend along the full perimeter of inner pipe 302.

In examples, housing 320 of first manifold 102 may be bonded or connected to first transition member 332. In examples, first joining end 326 of housing 320 of first manifold 102 may be bonded or connected to first transition member 332. In examples, first joining end 326 of housing 320 of first manifold 102 may be bonded or connected to an outer portion 346 of first transition member 332. In examples, first joining end 326 of housing 320 of first manifold 102 may be bonded or connected to an outer or exterior surface of portion 346 of first transition 332.

In examples, the bonding or connection of first joining end 326 to first transition member 332 may be accomplished by welding, mechanically such as by screws, clamps, brackets or the like, via adhesive or any combination thereof. In examples, first transition member 332 may be configured such that boding or connecting first transition member 332 to first joining end 326 of housing 320 may be performed by external welding. In examples, inner bore welding may not be required to connect first transition member 332 to first joining end 326 of housing 320.

In examples, first transition member 332 may be configured to form a sealed connection or bond between first inlet/outlet casting 316 and inner pipe 302. In examples, first transition member 332 may be configured to form a sealed connection or bond with first joining end 326 of housing 320 of first manifold 102.

In examples, housing 320 of first manifold 102 may be joined to the outer surface 314 of outer pipe 304. In examples, second joining end 328 of manifold housing 320 of first manifold 102 may be bonded or connected to outer surface 314 of outer pipe 304. In examples, the bonding or connection may be made via welding, mechanically, adhesive or any combination thereof. In examples, the bond or connection between second joining end 328 of manifold housing 320 of first manifold 102 may be bonded or connected to outer surface 314 of outer pipe 304 may be a sealed bond or connection. In examples, the bond or connection between second joining end 328 of manifold housing 320 of first manifold 102 may be bonded or connected to outer surface 314 of outer pipe 304 may be made via external welding.

In examples, sealed herein is used to indicate that the bond or connection is impermeable at least to the fluid intended to flow through the heat exchanger 106.

In examples, housing 320 of first manifold 102 may be bonded or connected to the outer surface 314 of outer pipe 304 at second joining end 328 and be bonded or connected to first transition member 332 at first joining end 326. In examples, once housing 320 is bonded or connected at first joining end 326 and second joining end 328, housing 320 may define a flow path to/from space 306 between inner pipe 302 and outer pipe 304 of double pipe heat exchanger 106.

In examples, the bonding or connection of housing 320 of first manifold 102 to the outer surface 314 of outer pipe 304 at second joining end 328 may be accomplished by welding, mechanically such as by screws, clamps, brackets or the like, via adhesive or any combination thereof. In examples, second joining end 328 may be configured such that boding or connecting second joining end 328 to the outer surface 314 of outer pipe 304 may be performed by external welding. In examples, inner bore welding may not be required to connect the outer surface 314 of outer pipe 304 to second joining end 328 of housing 320.

In examples, the bonding or connecting of first joining end 326 to first transition member 332 may be accomplished in the same or different manner as the bonding or connection of second joining end 328 to the outer surface 314 of outer pipe 304.

In examples, outer pipe 304 may include a recess or opening 350. In examples, a recess or opening 350 may be located proximate to, adjacent to, next to, or at a location corresponding to or provided above the location of inner pipe 302 where the first transition member 332 is to be bonded or connected. In examples, the recess or opening 350 may be a gap 354 located between outer pipe 304 and joining end 334 of first inlet/outlet casting 316. In examples, recess or opening 350 may be provided between an end rim 352 of outer pipe 304 and joining end 334 of first inlet/outlet casting 316. In examples, recess or opening 350 may be provided between an end rim 352 of outer pipe 304 and outer portion 338 of first inlet/outlet casting 316 and/or outer surface 342 of first inlet/outlet casting 316. In examples, recess or opening 350 may have a width that is larger than a width of the first transition member 332. In examples, the presence of the first transition member 332 may not be sufficient to compensate and/or close the recess or opening 350 between end rim 352 and first inlet/outlet casting 316. In example, a gap 354 is formed between end rim 352 and the first transition member 332. In examples, gap 354 may range from about 1 inch to about 2 inches. In examples, gap 354 may be part of recess or opening 350. In examples, recess or opening 350 and/or gap 354 may be configured such that at least a surface of the first transition member 332 may remain exposed to fluid passing through recess or opening 350 and/or gap 354 during normal operation.

In examples, recess or opening 350 and/or gap 354 may have a width that is less than a width of housing 320 of first manifold 102. In examples, recess or opening 350 and/or gap 354 may be configured to constrict the flow path between first manifold 102 and space 306. In examples, recess or opening 350 and/or gap 354 has a width dimension that is less than the distance between first joining end 326 of first manifold 102 and second joining end 328 of first manifold 102. In examples, a first baffle 356 may extend from recess or opening 350 and/or gap 354 and the second joining end 328 of first manifold 102 when bonded or connected to the outer surface 314 of outer pipe 304. In examples, first baffle 356 may be formed by a portion of the outer pipe 304. In examples, first baffle 356 may include or be formed by the portion of outer pipe 304 that extends from the location at which the second joining end 328 of housing 320 of first manifold 102 is bonded or connected to the outer surface 314 of outer pipe 304 to end rim 352. In examples, first baffle 356 may include a wall structure 358 that is configured to be bonded or connected to and/or extend outer pipe 304. In examples, first baffle 356 may be a protrusion from housing 320. In examples, first baffle 356 may be an integral portion of housing 320 and/or of first manifold 102. In examples, first baffle 356 may be an internal protrusion of housing 320. In examples, first baffle 356 may be configured to be bonded or connected to housing 320. In examples, wall structure 358 may be configured to be bonded or connected to overlay at least a portion of outer surface 314 of outer pipe 304. In examples, wall structure 358 may be bonded or connected to not overlay at least a portion of outer surface 314 of outer pipe 304. In examples, where wall structure 358 extends outer pipe 304, wall structure 358 may be configured to avoid contacting first transition member 332. In examples, gap 354 may be defined to be between the first transition member 332 and an edge 360 of wall structure 358 instead of end rim 352 of outer pipe 304.

In examples, recess or opening 350 and/or gap 354 may provide a flow opening into space 306. In examples, recess or opening 350 and/or gap 354 may be provided at a location of outer pipe 304 that is encased by housing 320 of the first manifold 102. In examples, by encasing the recess or opening 350 and/or gap 354, first baffle 356 and housing 320 of first manifold 102 may define a first flow path 362 from inside first manifold 102, through recess or opening 350 and/or gap 354, and into space 306. In examples, the defined first flow path 362 may deflect or induce flow of fluid toward the first transition member 332 and/or across at least a portion of a surface of first transition member 332. In examples, as illustrated in FIG. 3, fluid feed 364 from first manifold 102 may contact first baffle 356 and be deflected or redirected towards recess or opening 350 and/or gap 354 and/or first transition member 332. The fluid may then pass through recess or opening 350 and/or gap 354 and enter space 306. Similarly, if operated in an opposite flow, fluid from space 306 may be guided by first baffle 356 towards recess or opening 350 and/or gap 354 and/or first transition member 332. The fluid may then pass through recess or opening 350 and/or gap 354 and enter housing 320 of first manifold 102. In examples, fluid flow through recess or opening 350 and/or gap 354 may flow across a surface of first transition member 332. In examples, flow across a surface of first transition member 332 may help decrease and/or control the temperature of the first transition member 332 during operation. In examples, this may result in improved structural properties.

FIG. 4 illustrated a cross-view of an example piping connection system that may be used to connect first manifold 102 or second manifold 104 to a double pipe heat exchanger. In examples, 400 illustrates a piping connection system between a second manifold 104 and a double pipe heat exchanger 106. As illustrated, the example piping connection system of FIG. 4 may be similar in many respects to the piping connection system described with reference to FIG. 3.

In examples, a double pipe heat exchanger 106 is illustrated in FIG. 4 by inner pipe 402 and outer pipe 404. In examples, the portion of double pipe heat exchanger 106 in FIG. 4 may be a different portion of the same or different double pipe heat exchanger 106 discussed with reference to FIG. 3. In examples, the double pipe heat exchanger 106 of FIG. 4 may have the same features described with respect to FIG. 3. For example, a space 406 defined between inner pipe 402, and outer pipe 404. For example, inner pipe 402 may include an inner surface 408 and outer surface 410. Similarly, outer pipe 404 may include an inner surface 412 and outer surface 414. In examples, inner pipe 402 and outer pipe 404 may include the same materials as described earlier for inner and outer pipes 302 and 304.

In examples, a second inlet/outlet casting 416 may be configured to conduct flow into or out of inner pipe 402. In examples, second inlet/outlet casting 416 may be the same or different shape as the first inlet/outlet casting 316. In examples, second inlet/outlet casting 416 may be an inlet pipe or outlet pipe. In examples, second inlet/outlet casting 416 may be configured to be bonded or connected to a second end 418 of double pipe heat exchanger 106. In examples, second end 418 may be spaced apart from first end 318. In examples, second end 418 may be at an opposite side or end of a double pipe heat exchanger 106 from first end 318.

In examples, a second transition member 432 may be provided to transition from second inlet/outlet casting 416 to inner pipe 402 of double pipe heat exchanger 106. In examples, second transition member 432 may have any desirable shape as described previously for the first transition member 332. In examples, the second transition member 432 may have the same or different shape than the first transition member 332. In examples, second transition member 432 has a shape that is different from that of first transition member 332. In examples, second transition member 432 may have a generally planar surface on one side and a non-planar surface on a second, opposite side.

In examples, like first transition member 332, the second transition member 432 may include an outer portion 446, and an inner portion 448. In examples, the outer portion 446 and the inner portion 448 may be two halves of second transition member 432. In examples, outer portion 446 may include an outer or external surface, i.e. closest to outer pipe 404 when second transition member 432 is installed. In examples, inner portion 448 may include an inner or internal surface, i.e. closest to inner pipe 402 when second transition member 432 is installed. In examples, inner portion 448 of second transition member 432 may include a planar or substantially planar or flat inner or internal surface. In examples, the outer portion 446 of second transition member 432 may include a protrusion 464 to which housing 420 of second manifold 104 may be bonded or connected.

In examples, independent of the shape, the second transition member 432 may include one or more features, although may be having different designs, as first transition member 332.

In examples, second inlet/outlet casting 416 may include a joining end 434, an inner portion 436, an outer portion 438, an inner surface 440, and an outer surface 442 and similarly described earlier for the first inlet/outlet casting 316. In examples, inner surface 440 of second inlet/outlet casting 416 may be configured to form a contiguous flow path with inner surface 408 of inner pipe 402 when installed. In examples, outer portion 438 of second inlet/outlet casting 416 may include an outer surface 442 of second inlet/outlet casting 416. In examples, outer surface 442 of second inlet/outlet casting 416 may be substantially coplanar with outer surface 414 of outer pipe 404. In examples, outer surface 442 of second inlet/outlet casting 416 may not be coplanar with outer surface 414 of outer pipe 404.

In examples, second transition element 432 may be provided along at least a portion of perimeter 444 of second inlet/outlet casting 416. In examples, second transition member 432 may be configured to extend along the full perimeter 444 of inner surface 440 and/or outer surface 442 of second inlet/outlet casting 416 when present and/or when bonded or connected to second inlet/outlet casting 416.

In examples, the second transition member 432 may be bonded or connected to inner pipe 402 at an inner portion 448. In examples, the external welding may be performed to bond or connect second transition member 432 to inner pipe 402. In examples, the welding may be performed at outer surface 410 and/or at second end 418 of inner pipe to connect second transition member 432 to inner pipe 402. In examples, inner bore welding may not be required to connect second transition member 432 to inner pipe 402. In examples, as previously described, when second transition member 432 may be present at joining end 434 of second inlet/outlet casting 416, the outer portion 446 may include an outer or external surface of second transition member 432 that is closest to the outer surface 442 of second inlet/outlet casting 416, while the inner portion 448 may include an inner or internal surface that is closest to the inner surface 440 of second inlet/outlet casting 416.

In examples, when bonded and/or connected to inner pipe 402, second transition member 432 may extend along at least a portion of the perimeter of inner pipe 402. In examples, when bonded and/or connected to inner pipe 402, second transition member 432 may extend along the full perimeter of inner pipe 402.

In examples, second transition member 432 may be configured to form a sealed connection or bond between second inlet/outlet casting 416 and inner pipe 402. In examples, second transition member 432 may be configured to form a sealed connection or bond with second joining end 426 of housing 420 of second manifold 104.

In examples, the second manifold 104 may have the same or different structure to first manifold 102. In examples, second manifold 104 may be formed of or include any of the same materials as described for first manifold 102. In examples, second manifold 104 may be made of the same or different material as first manifold 102. In examples, second manifold 104 may include one or more of the same features as described for first manifold 102. For example, second manifold 104 may include a housing 420, and the housing may include an inner surface 422 and an outer surface 424. In examples, the second manifold 104 and/or housing 420 may include a first joining end 426 and a second joining end 428. In examples, first joining end 426 of second manifold 104 may be at an opposite side of housing 420 from second joining end 428 of second manifold 104. In examples, second manifold 104 may include two or more section 430*a*, 430*b*, etc., that may be bonded or connected together to form housing 420 as previously described with respect to housing 320 of the first manifold 102.

In examples, housing 420 of second manifold 104 may be bonded or connected to second transition member 432. In examples, first joining end 426 of housing 420 of second manifold 104 may be bonded or connected to second transition member 432. In examples, first joining end 426 of housing 420 of second manifold 104 may be bonded or connected to an outer portion 446 of second transition member 432. In examples, first joining end 426 of housing 420 of second manifold 104 may be bonded or connected to an outer or external surface of outer portion 446 of second transition 432.

In examples, the bonding or connection of first joining end 426 to second transition member 432 may be accomplished by welding, mechanically such as by screws, clamps, brackets or the like, via adhesive or any combination thereof. In examples, second transition member 432 may be configured such that boding or connecting second transition member 432 to first joining end 426 of housing 420 may be performed by external welding. In examples, inner bore welding may not be required to connect second transition member 432 to first joining end 426 of housing 420.

In examples, housing 420 of second manifold 104 may be joined to the outer surface 414 of outer pipe 404. In examples, second joining end 428 of manifold housing 420 of second manifold 104 may be bonded or connected to outer surface 414 of outer pipe 404. In examples, the bonding or connection may be made via welding, mechanically, adhesive or any combination thereof. In examples, the bond or connection between second joining end 428 of manifold housing 420 of second manifold 104 may be bonded or connected to outer surface 414 of outer pipe 404 may be a sealed bond or connection. In examples, the bond or connection between second joining end 428 of manifold housing 420 of second manifold 104 may be bonded or connected to outer surface 414 of outer pipe 404 may be made via external welding.

In examples, housing 420 of second manifold 104 may be bonded or connected to the outer surface 414 of outer pipe 404 at second joining end 428 and be bonded or connected to second transition member 432 at second joining end 426. In examples, once housing 420 is bonded or connected at second joining end 426 and second joining end 428, housing 420 may define a flow path to/from space 406 between inner pipe 402 and outer pipe 404 of double pipe heat exchanger 106.

In examples, the bonding or connection of housing 420 of second manifold 104 to the outer surface 414 of outer pipe 404 at second joining end 428 may be accomplished by welding, mechanically such as by screws, clamps, brackets or the like, via adhesive or any combination thereof. In examples, second joining end 428 may be configured such that boding or connecting second joining end 428 to the outer surface 414 of outer pipe 404 may be performed by external welding. In examples, inner bore welding may not be required to connect the outer surface 414 of outer pipe 404 to second joining end 428 of housing 420.

In examples, the bonding or connecting of first joining end 426 to second transition member 432 may be accomplished in the same or different manner as the bonding or connection of second joining end 428 to the outer surface 414 of outer pipe 404.

In examples, outer pipe 404 may include a recess or opening 450 similarly as described with respect to outer pipe 304 and recess or opening 350 with reference to FIG. 3. In examples, outer pipe 404 may include a recess or opening 450. In examples, a recess or opening 450 may be located proximate to, adjacent to, next to, or at a location corresponding to or provided above the location of inner pipe 402 where the second transition member 432 is to be bonded or connected. In examples, the recess or opening 450 may be a gap 454 located between outer pipe 404 and joining end 434 of second inlet/outlet casting 416. In examples, recess or opening 450 may be provided between an end rim 452 of outer pipe 404 and joining end 434 of second inlet/outlet casting 416. In examples, recess or opening 450 may be provided between an end rim 452 of outer pipe 404 and outer portion 438 of second inlet/outlet casting 416 and/or outer surface 442 of second inlet/outlet casting 416. In examples, recess or opening 450 may have a width that is larger than a width of the second transition member 432. In examples, the presence of the second transition member 432 may not be sufficient to compensate and/or close the recess or opening 450 between end rim 452 and second inlet/outlet casting 416. In example, a gap 454 is formed between end rim 452 and the second transition member 432. In examples, gap 454 may be part of recess or opening 450. In examples, recess or opening 450 and/or gap 454 may be configured such that at least a surface of the second transition member 432 may remain exposed to fluid passing through recess or opening 450 and/or gap 454 during normal operation.

In examples, recess or opening 450 and/or gap 454 may have a width that is less than a width of housing 420 of second manifold 104. In examples, recess or opening 450 and/or gap 454 may be configured to constrict the flow path between first manifold 104 and space 406. In examples, recess or opening 450 and/or gap 454 has a width dimension that is less than the distance between second joining end 426 of second manifold 104 and second joining end 428 of second manifold 104. In examples, a second baffle 456 may extend from recess or opening 450 and/or gap 454 and the second joining end 428 of second manifold 104 when bonded or connected to the outer surface 414 of outer pipe 404. In examples, second baffle 456 may be formed by a portion of the outer pipe 404. In examples, second baffle 456 may include or be formed by the portion of outer pipe 404 that extends from the location at which the second joining end 428 of housing 420 of second manifold 104 is bonded or connected to the outer surface 414 of outer pipe 404 to end rim 452. In examples, second baffle 456 may include a wall structure 458 that is configured to be bonded or connected to and/or extend outer pipe 404. In examples, second baffle 456 may be a protrusion from housing 420. In examples, second baffle 456 may be an integral portion of housing 420 and/or of second manifold 104. In examples, second baffle 456 may be an internal protrusion of housing 420. In examples, second baffle 456 may be configured to be bonded or connected to housing 420. In examples, wall structure 458 may be configured to be bonded or connected to overlay at least a portion of outer surface 414 of outer pipe 404. In examples, wall structure 458 may be bonded or connected to not overlay at least a portion of outer surface 414 of outer pipe 404. In examples, where wall structure 458 extends outer pipe 404, wall structure 458 may be configured to avoid contacting second transition member 432. In examples, gap 454 may be defined to be between the second transition member 432 and an edge 460 of wall structure 458 instead of end rim 452 of outer pipe 404.

In examples, recess or opening 450 and/or gap 454 may provide a flow opening into space 406. In examples, recess or opening 450 and/or gap 454 may be provided at a location of outer pipe 404 that is encased by housing 420 of the second manifold 104. In examples, by encasing the recess or opening 450 and/or gap 454, second baffle 456 and housing 420 of second manifold 104 may define a second flow path 462 from space 406, through recess or opening 450 and/or gap 454, and into second manifold 104. In examples, the defined second flow path 462 may induce flow of fluid towards the second transition member 432 and/or across at least a portion of a surface of second transition member 432. In examples as illustrated in FIG. 4, second baffle 456 may be configured such that fluid from space 406 may be guided by second baffle 456 towards recess or opening 450 and/or gap 454 and/or second transition member 432. The fluid may then pass through recess or opening 450 and/or gap 454 and enter housing 420 of second manifold 104 and then outflow at 466. Similarly, if operated in opposite flow, fluid feed from second manifold 104 may contact second baffle 456 and be deflected or redirected towards recess or opening 450 and/or gap 454 and/or second transition member 432. The fluid may then pass through recess or opening 450 and/or gap 454 and enter space 406. In examples, fluid flow through recess or opening 450 and/or gap 454 may flow across a surface of second transition member 432. In examples, flow across a surface of second transition member 432 may help decrease and/or control the temperature of the second transition member 432 during operation. In examples, this may result in improved structural properties.

In examples, as illustrated in FIG. 1, a PQE may include a bank of multiple double pipe heat exchangers 106. In examples, a first manifold 102 may be coupled to and/or in fluid connection with two or more double pipe heat exchangers 106. In examples, a first manifold 102 coupled to and/or in fluid connection with two or more double pipe heat exchangers 106 may include a pipe connection system as described with reference to FIG. 3 or 4 for one or more double pipe heat exchangers. In examples, a first manifold 102 coupled to and/or in fluid connection with two or more double pipe heat exchangers 106 may include a pipe connection system as described with reference to FIG. 3 or 4 for each double pipe heat exchanger 106.

In examples, as further illustrated in FIG. 1, a PQE may include a second manifold 104 coupled to and/or in fluid connection with a bank of one or more double pipe heat exchangers 106. In examples, a second manifold 104 coupled to and/or in fluid connection with two or more double pipe heat exchangers 106 may include a pipe connection system as described with reference to FIG. 3 or 4 for one or more double pipe heat exchangers. In examples, a second manifold 104 coupled to and/or in fluid connection with two or more double pipe heat exchangers 106 may include a pipe connection system as described with reference to FIG. 3 or 4 for each double pipe heat exchanger 106.

In examples, a quench exchanger such as a PQE may include a first manifold 102 including one or more pipe connection system as described with reference to FIG. 3 and a second manifold 104 include one or more connection system as described with reference to FIG. 4. In examples, a quench exchanger such as a PQE may include a plurality of double pipe heat exchangers 106, a first manifold 102 including a pipe connection system as described with reference to FIG. 3 in each fluid connection to each double pipe heat exchanger 106 of the plurality of the double pipe heat exchangers, and a second manifold 104 include one or more connection system as described with reference to FIG. 4 in each fluid connection to each double pipe heat exchanger 106 of the plurality of the double pipe heat exchangers.

In examples, a quench exchanger such as a PQE may be configured so that a first fluid can flow through the inner pipe of each double pipe system such as double pipe heat exchanger and a second fluid can flow between the first and second manifolds by way of the space between inner pipe and outer pipe of each double pipe system or double pipe heat exchanger. In examples, heat transfer may be achieved between first fluid and second fluid by concurrent or counter current flow.

In examples, as previously shown in FIG. 1, a quench exchanger such as a PQE may include a first manifold 102 located proximate to a first end of one or more double pipe heat exchangers 106 along with respective first transition members 332 and a second manifold 104 located proximate to a second end of one or more double pipe heat exchangers 106 along with respective second transition members 432, wherein the first end of the one or more double pipe heat exchangers 106 is opposite the second end of the one or more double pipe heat exchangers 106. In such an example, it should be understood that space 306 and space 406 form a single contiguous space between inner and outer pipes.

In examples, for each double pipe heat exchanger, a first fluid may flow into the inner pipe of the double pipe heat exchanger via the respective first inlet/outlet casting 316. In examples, the first fluid may travel the length of the inner pipe and exit at the opposite end traveling through respective second inlet/outlet casting 416. Meanwhile, a second fluid may be inlet into second manifold 104 via inlet 108, flow through respective gap 454 and into the respective space between the inner and outer pipe of each double pipe heat exchanger. The second fluid may travel the length of the space between inner and outer pipes and then flow through gap 354 and into the first manifold 102 and out outlet 110. In examples, heat transfer may occur between the first fluid and second fluid while they flow through the quench exchanger or PQE. In examples, the flow direction of the first fluid and second fluid may be independently reversed and controlled.

In examples, the first or second manifold of a quench exchanger or PQE may be configured to conduct boiler feed water. In examples, the first or second manifold of a quench exchanger or PQE may be configured to conduct a steam. In examples, the first or second manifold of a quench exchanger or PQE may be a boiler feed water manifold and the other manifold may be a steam manifold.

In examples, a quench exchanger or PQE may include a first manifold 102 connected as described with reference to FIG. 3 to conduct boil feed water. In examples, a quench exchanger or PQE may include a second manifold 104 connected as described with reference to FIG. 4 to conduct steam. In examples, a quench exchanger or PQE may include a first manifold 102 to conduct boil feed water and second manifold 104 to conduct steam, where the first manifold 102 is connected to the quench exchanger or PQE as described with reference to FIG. 3 and the second manifold 104 is connected to the quench exchanger or PQE as described with reference to FIG. 4.

Figure 5:
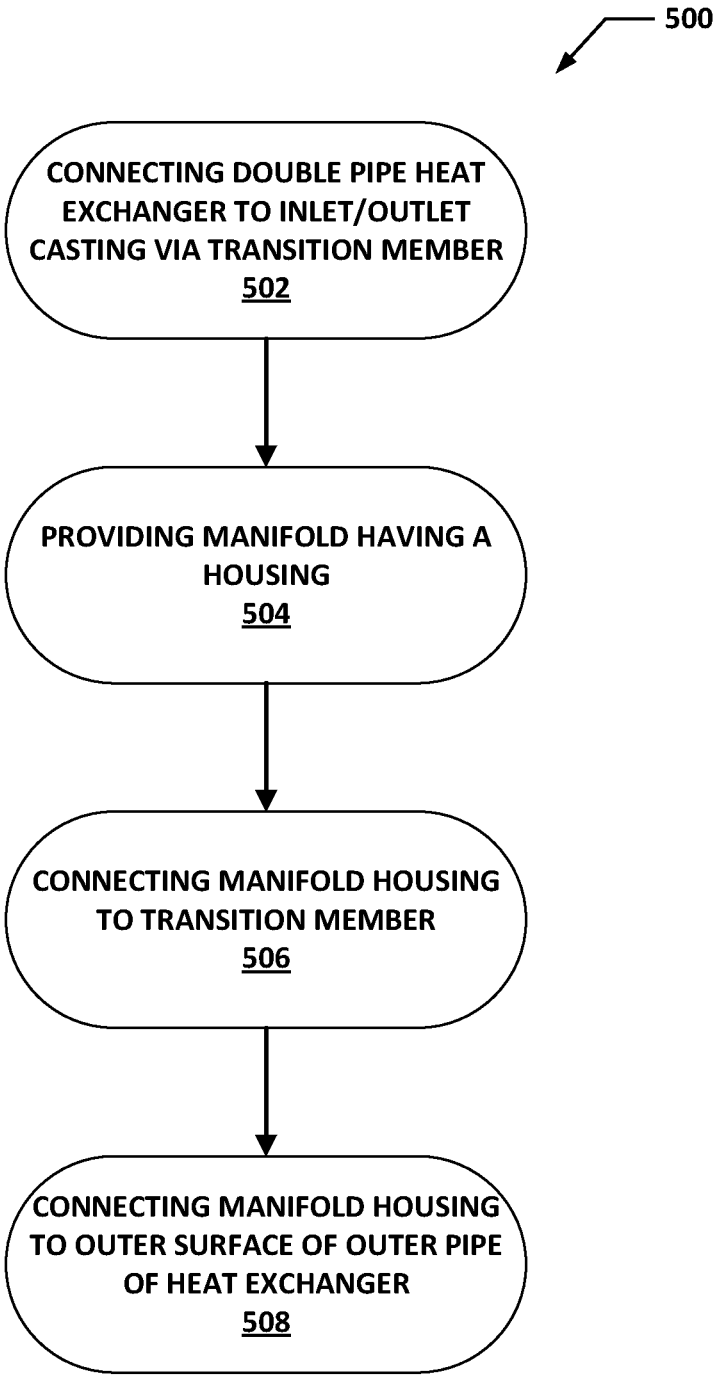
FIG. 5 illustrates a process diagram of an example process of making a piping connection system as described herein.

In examples, an overall process 500 of making a pipe connection in accordance to the details previously described is illustrated in FIG. 5. In examples, at 502 a double pipe heat exchanger may be bonded or connected to an inlet/outlet casting via a transition member as previously described with reference to FIGS. 3 and 4. In examples, the bonding or connection may be performed via welding, mechanically such as by screws, clamps, brackets or the like, via adhesive or any combination thereof. In examples, the connection or bonding may be performed by external and/or direct welding. In examples, the transition member may be bonded or connected to the double pipe heat exchanger on a first side and to the inlet/outlet casting on a second side also as previously described with reference to FIGS. 3 and 4. In examples, as also discussed earlier, double pipe heat exchanger may be bonded to the inlet/outlet casting via the transition member such that a contiguous flow path is formed from the inlet/outlet casting to the inner pipe of the double pipe heat exchanger. As discussed with reference to FIGS. 3 and 4, in examples, once bonded to the double pipe heat exchanger and the inlet/outlet casting, the transition member may remain exposed by a recess, opening, or gap between outer pipe of the double pipe heat exchanger and the inlet/outlet casting.

In examples, at 504 a manifold housing is provided. In examples, at 506 a manifold housing is bonded or connected to the transition member as discussed earlier with reference to FIGS. 3 and 4. In examples, at 508 the manifold housing is bonded or connected to an outer surface of the outer pipe of the double pipe heat exchanger also as previously discussed. In examples, bonding or connections 506 and 508 may be performed in either order and/or simultaneously. In examples, by bonding or connecting manifold housing to the double pipe heat exchanger and to the transition member, a flow path is formed as described with reference to FIGS. 3 and 4. As discussed earlier, in examples, the formed flow path forces fluid to pass through the recess, opening, or gap between the outer pipe of the heat exchanger and the inlet/outlet casting and across a surface of the transition member.

Figure 6:
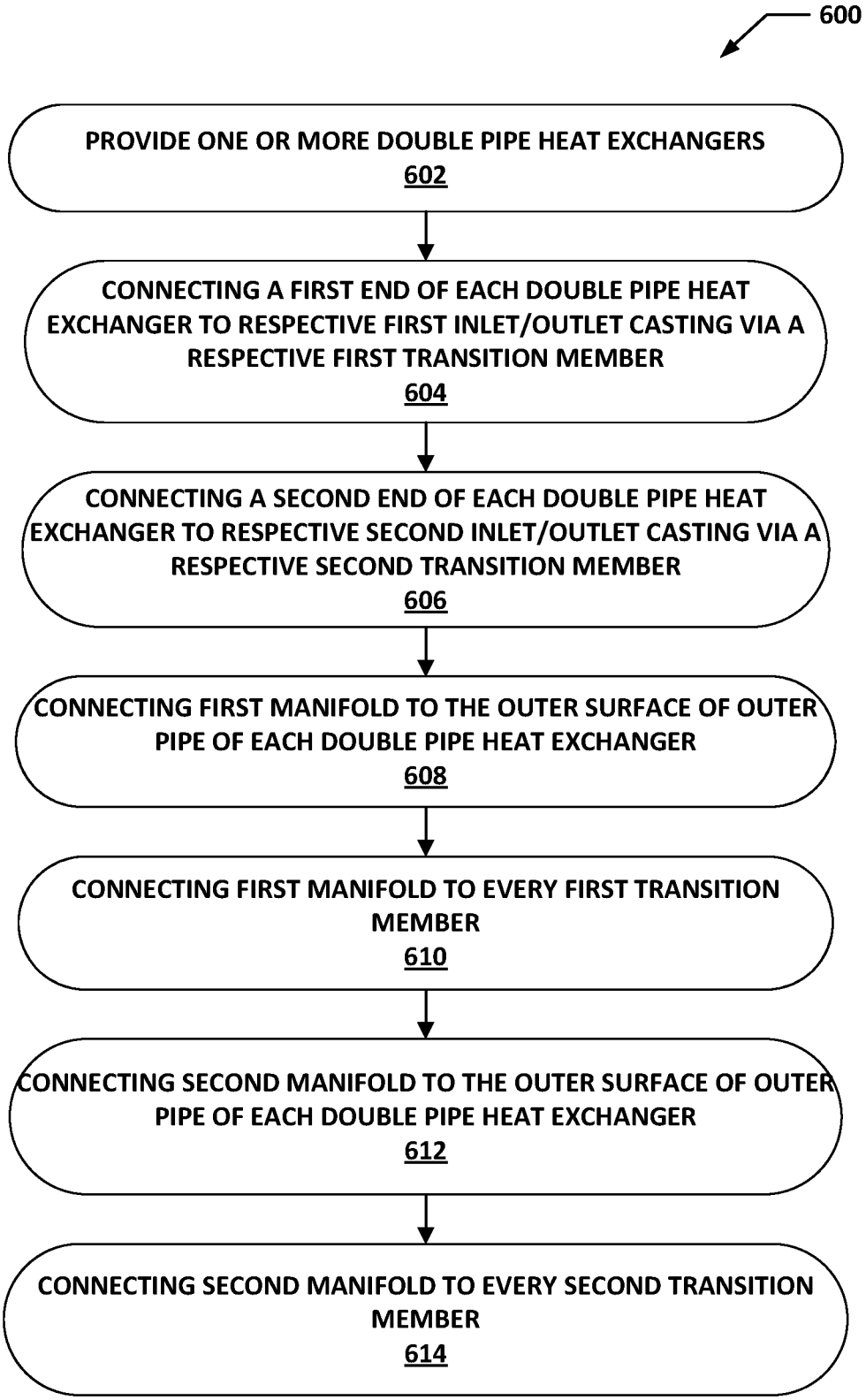
FIG. 6 illustrates a process diagram of an example process of making a quench exchanger employing one or more piping connection systems as described herein.

In examples, a process 600 of making a quench exchanger such as a PQE is illustrated in FIG. 6. In examples, at 602 a bank of one or more double pipe heat exchangers may be provided. In examples, at 604 a first end of each double pipe heat exchanger may independently be bonded or connected to a respective first inlet/outlet casting via a respective first transition member as described earlier and with reference to FIG. 5.

In examples, at 606 a second end of each double pipe heat exchanger may independently be bonded or connected to a respective second inlet/outlet casting via a respective second transition member also as described earlier and with reference to FIG. 5. In examples, the first end and second end of each double pipe heat exchanger may be at opposite sides of the double pipe heat exchanger.

In examples, at 608 a first manifold housing may be bonded or connected to the outer surface of the outer pipe of each double pipe heat exchanger. In examples, the same first manifold may be connected to all the double pipe heat exchangers. In examples, the first manifold housing may be connected to the outer surface of the outer pipe of each double pipe heat exchanger at a location that is at the same end portion or proximate to the same end portion of each double pipe heat exchanger where each respective first transition member may be bonded or connected.

In examples, at 610 the first manifold housing may be bonded or connected to each first transition member of the respective double pipe heat exchangers in the same manner as described earlier and with reference to FIG. 5. In examples, the same first manifold housing may be connected to all of the first transition members. In examples, the bonding or connections at 608 and 610 may be performed in reverse order and/or simultaneously.

In examples, at 612 a second manifold housing may be bonded or connected to the outer surface of the outer pipe of each double pipe heat exchanger. In examples, the same second manifold may be connected to all the double pipe heat exchangers. In examples, the second manifold housing may be connected to the outer surface of the outer pipe of each double pipe heat exchanger at a location that is at the same end portion or proximate to the same end portion of each double pipe heat exchanger where each respective second transition member may be bonded or connected.

In examples, at 614 the second manifold housing may be bonded or connected to each second transition member of the respective double pipe heat exchangers in the same manner as described earlier and with reference to FIG. 5. In examples, the same second manifold housing may be connected to all the second transition members. In examples, the bonding or connections at 612 and 614 may be performed in reverse order and/or simultaneously.

In examples, at 604, 608, and 610 the process may reflect a bonding or connection as described with reference to FIG. 3. In examples, at 606, 612, and 614 the process may reflect a bonding or connection as described with reference to FIG. 4. In examples, these may be inverted with 604, 608, and 610 reflecting a bonding or connection of FIGS. 4 and 606, 612, and 614 reflecting a bonding or connection of FIG. 3. In examples, at 604-614 reflect a bonding or connection of only FIG. 3 or only FIG. 4.

It will be apparent to those skilled in the art that various modifications and variation can be made without departing from the spirit or scope of the invention. Thus, it is intended that the above disclosure covers the modifications and variations of this invention provided they come within the scope of the appended claims and their equivalents.

What is claimed is:

1. A method of making a flow connection to a double pipe heat exchanger comprising:

directly bonding via external welding a first transition member to a portion of a first outer surface of an inner pipe of the double pipe heat exchanger; and bonding a first manifold to the first transition member and to an outer surface of an outer pipe of the double pipe heat exchanger.

2. The method of claim 1, wherein the first transition member is bonded to the portion of the first outer surface of the inner pipe of the double pipe heat exchanger that is proximate to a first opening at the outer surface of the outer pipe of the double pipe heat exchanger.

3. The method of claim 2, further comprising bonding the first manifold to the first transition member and to the outer surface of the outer pipe to define a first flow path from the first manifold, through the first opening, and into a space between the inner pipe of the double pipe heat exchanger and the outer pipe of the double pipe heat exchanger, wherein the first opening is configured to constrict the first flow path from the first manifold to the space between the inner pipe of the double pipe heat exchanger and the outer pipe of the double pipe heat exchanger.

4. The method of claim 1, further comprising:

bonding via external welding a second transition member to a surface of a second portion of the outer surface of the inner pipe of the double pipe heat exchanger; and bonding a second manifold to the second transition member and to the outer surface of an outer pipe of the double pipe heat exchanger.

5. The method of claim 4, wherein the second transition member is bonded to the second portion of the outer surface of the inner pipe of the double pipe heat exchanger that is proximate to a second opening at the outer surface of the outer pipe of the double pipe heat exchanger.

6. The method of claim 5, further comprising bonding the second manifold to the second transition member and to the outer surface of the outer pipe to define a second flow path from the second manifold, through the second opening, and into the space between the inner pipe of the double pipe heat exchanger and the outer pipe of the double pipe heat exchanger, wherein the second opening is configured to constrict the second flow path from the second manifold to the space between the inner pipe of the double pipe heat exchanger and the outer pipe of the double pipe heat exchanger.

7. A method of making a primary quench exchanger comprising:

providing a plurality of double pipe heat exchangers, each double pipe heat exchanger comprising an inner pipe located within an outer pipe;

directly bonding via external welding a respective first transition member to a first portion of an outer surface of each inner pipe of each double pipe heat exchanger; and bonding a first manifold to the first transition member and to an outer surface of each outer pipe of the double pipe heat exchanger.

8. The method of claim 7, wherein each first transition member is bonded to the first portion of an outer surface of each respective inner pipe of the double pipe heat exchanger that is proximate to a first opening at each respective outer pipe of each double pipe heat exchanger.

9. The method of claim 8, further comprising bonding the first manifold to each first transition member and to the outer surface of each outer pipe of the double pipe heat exchanger further comprises defining a respective first flow path from the first manifold to each double pipe heat exchanger, wherein each respective first flow path extends from the first manifold, through the first opening in each respective outer pipe of each double pipe heat exchanger, and into a space between each respective inner pipe and outer pipe of each double pipe heat exchanger, wherein the first opening in each respective outer pipe of each double pipe heat exchanger is configured to constrict the respective first flow path from the first manifold to the respective space between the inner pipe and the outer pipe of the respective double pipe heat exchanger.

10. The method of claim 7, further comprising:

bonding via external welding a respective second transition member to a second portion of an outer surface of each inner pipe of each double pipe heat exchanger; and bonding a second manifold to the second transition member and to the outer surface of each outer pipe of the double pipe heat exchanger.

11. The method of claim 10, wherein each second transition member is bonded to the second portion of an outer surface of each respective inner pipe of the double pipe heat exchanger that is proximate to a second opening at each respective outer pipe of each double pipe heat exchanger.

12. The method of claim 11, further comprising bonding the second manifold to each second transition member and to the outer surface of each outer pipe of the double pipe heat exchanger further comprises defining a respective second flow path from the second manifold to each double pipe heat exchanger, wherein each respective second flow path extends from the second manifold, through the second opening in each respective outer pipe of each double pipe heat exchanger, and into a space between each respective inner pipe and outer pipe of each double pipe heat exchanger, wherein the second opening in each respective outer pipe of each double pipe heat exchanger is configured to constrict the respective second flow path from the second manifold to the respective space between the inner pipe and the outer pipe of the respective double pipe heat exchanger.

* * * * *